US011255032B2

(12) United States Patent
Uehata et al.

(10) Patent No.: US 11,255,032 B2
(45) Date of Patent: Feb. 22, 2022

(54) POLYESTER BINDER FIBER

(71) Applicant: KURARAY CO., LTD., Kurashiki (JP)

(72) Inventors: Akihiro Uehata, Kurashiki (JP); Hayato Hohman, Osaka (JP); Satoshi Koizumi, Kurashiki (JP)

(73) Assignee: KURARAY CO., LTD., Kurashiki (JP)

( * ) Notice: Subject to any disclaimer, the term of this patent is extended or adjusted under 35 U.S.C. 154(b) by 214 days.

(21) Appl. No.: 16/449,889

(22) Filed: Jun. 24, 2019

(65) Prior Publication Data

US 2019/0309456 A1 Oct. 10, 2019

Related U.S. Application Data

(63) Continuation of application No. PCT/JP2017/046467, filed on Dec. 25, 2017.

(30) Foreign Application Priority Data

Dec. 26, 2016 (JP) ..... JP2016-250705

(51) Int. Cl.

| | |
|---|---|
| ***D04H 1/55*** | (2012.01) |
| ***D01F 6/92*** | (2006.01) |
| ***D04H 1/732*** | (2012.01) |
| ***D21H 13/24*** | (2006.01) |

(52) U.S. Cl.

CPC ..... *D04H 1/55* (2013.01); *D01F 6/92* (2013.01); *D04H 1/732* (2013.01); *D21H 13/24* (2013.01); *D10B 2331/04* (2013.01)

(58) Field of Classification Search

CPC combination set(s) only.
See application file for complete search history.

(56) References Cited

U.S. PATENT DOCUMENTS

| | | | |
|---|---|---|---|
| 6,280,843 | B1 | 8/2001 | Murayama et al. |
| 9,422,643 | B2 | 8/2016 | Endo et al. |
| 9,518,341 | B2 | 12/2016 | Endo et al. |
| 9,809,905 | B2 | 11/2017 | Endo et al. |
| 9,890,478 | B2 | 2/2018 | Inagaki |
| 9,982,368 | B2 | 5/2018 | Uehata et al. |
| 10,253,434 | B2 | 4/2019 | Nakamura et al. |
| 2010/0133173 | A1 | 6/2010 | Inagaki |
| 2012/0015184 | A1 | 1/2012 | Endo et al. |
| 2013/0123437 | A1 | 5/2013 | Endo et al. |
| 2013/0260124 | A1 | 10/2013 | David et al. |
| 2015/0069654 | A1 | 3/2015 | Endo et al. |
| 2015/0167199 | A1* | 6/2015 | Endo ..... C08L 67/02 525/425 |
| 2015/0315725 | A1 | 11/2015 | Uehata et al. |
| 2016/0060461 | A1 | 3/2016 | David et al. |
| 2017/0016149 | A1 | 1/2017 | Nakamura et al. |

FOREIGN PATENT DOCUMENTS

| | | | |
|---|---|---|---|
| CN | 1237657 | A | 12/1999 |
| CN | 101680185 | A | 3/2010 |
| CN | 102362021 | A | 2/2012 |
| CN | 103025934 | A | 4/2013 |
| CN | 104169482 | A | 11/2014 |
| CN | 106133216 | | 11/2016 |
| JP | 2001-271227 | | 10/2001 |
| JP | 2011-127252 | | 6/2011 |
| JP | 2013-174028 | | 9/2013 |
| WO | WO2012/014713 | A1 | 2/2012 |
| WO | WO2014/112423 | A1 | 7/2014 |
| WO | WO2015/152082 | A1 | 10/2015 |

OTHER PUBLICATIONS

International Search Report dated Mar. 20, 2018 in International Application PCT/JP2017/046467, filed on Dec. 25, 2017.
Extended European Search Report dated Jul. 27, 2020 in European Application No. 17886589.5.
Office Action dated Apr. 6, 2021 in Chinese Application No. 201780080112 with English translation, 15 pages.
Communication pursuant to Article 94(3) EPC dated Apr. 16, 2021 in European Application No. 17 886 589.5.
Yu-jian Wei, "*Textile Applied Chemistry*," China Textile & Apparel Press, May 31, 2007, p. 319 with English machine translation.
Chinese Office Action dated Oct. 21, 2021 in Chinese Application No. 201780080112.4, with English translation, 16 pages.
"Fundamentals of polymer physics Principles of plastics molding process", edited by Shan xi sheng su liao gong cheng xue hui, published by Shan xi sheng gong ye ke ji qing bao zhan deng, Dec. 1981, p. 45, with partial English translation.
Yan Haojing, "Introduction of fiber materials", published by Fang zhi gong ye chu ban she, Dec. 31, 1990, p. 249, with partial English translation.

* cited by examiner

*Primary Examiner* — Lynda Salvatore
(74) *Attorney, Agent, or Firm* — Grüneberg and Myers PLLC

(57) ABSTRACT

The problem to be solved by the present invention is to provide a polyester binder fiber having a low crystallization temperature and exhibiting improved adhesiveness and a fiber structure including the polyester binder fiber. The polyester binder fiber according to the present invention includes a polyester polymer and an amorphous polyether imide polymer in a proportion of 0.1 to 5.0 mass % (based on the mass of the polyester polymer), and the polyester binder fiber has a crystallization temperature measured by differential calorimetry in a range of 100° C. or higher and 250° C. or lower.

11 Claims, No Drawings

POLYESTER BINDER FIBER

CROSS REFERENCE TO THE RELATED APPLICATION

This application is a continuation application, under 35 U.S.C. § 111(a) of international application No. PCT/JP2017/046467, filed Dec. 25, 2017, which claims priority to Japanese patent application No. 2016-250705, filed Dec. 26, 2016, the entire disclosure of which is herein incorporated by reference as a part of this application.

FIELD OF THE INVENTION

The present invention relates to a polyester binder fiber suitable for binding drawn polyester fibers (polyester subject fibers) to produce fiber structures, such as wetlaid nonwoven fabrics and papers.

BACKGROUND OF THE INVENTION

Conventionally, polyethylene fibers, polyvinyl alcohol fibers, etc. are used as binder fibers for papermaking. Recently, papers made of polyester fibers in part or all as raw materials have been more commonly used because the polyester fibers have excellent physical properties such as a mechanical property, an electrical property, heat resistance, dimensional stability and hydrophobicity, as well as cost advantage. Further, with increasing amounts of use and applications of the polyester fibers, there is a demand for binder fibers to have improved adhesiveness so as to make it possible to produce a paper with high strength.

Patent Document 1 (JP Laid-open Patent Publication No. 2013-174028) discloses an undrawn polyester binder fiber for papermaking. In order to obtain a paper with high strength, the undrawn polyester binder fiber has an intrinsic viscosity of 0.50 to 0.60, a single fiber fineness of 1.0 to 2.0 dtex, and a fiber length of 3 to 15 mm, wherein a salt of alkyl phosphate is applied to the undrawn fiber in a proportion of 0.002 to 0.05% by mass. Patent Document 1 describes that production of a fiber having a single fiber fineness of less than 1.0 dtex causes frequent fiber breakage due to low tenacity of monofilament, and deterioration in water dispersibility of the obtained fibers.

Patent Document 2 (International Publication No. WO2015/152082) discloses that a binder fiber having a low fineness and contributing to high paper strength can be obtained, in which the binder fiber comprises a polyester containing 0.1 to 5 mass % of a polymer such as polymethyl methacrylate.

SUMMARY OF THE INVENTION

Problems to be Solved by the Invention

Patent Document 1 does not recite to reduce the single fiber fineness of the polyester binder fiber for papermaking because Patent Document 1 describes that production of a fiber having a single fiber fineness of less than 1.0 dtex causes frequent fiber breakage because of small tenacity of monofilament, as well as deterioration in water dispersibility of the obtained fibers.

Patent Document 2 discloses that a paper having high paper strength can be obtained by using a binder fiber comprising a polyester containing 0.1 to 5 mass % of a polymer such as polymethyl methacrylate, regardless of a low fineness of the binder fiber. However, there is a problem that use of this binder fiber makes obtained paper thicker because a high crystallization temperature of the binder fiber causes difficulty in melting.

Accordingly, the inventors of the present application started to study the present invention and have found that although the single fiber fineness of the polyester binder fiber can be selected depending on the purpose of use, there has been a demand for fibers to have balanced properties among processability, thinness of the resulting paper and paper strength. Achievement of a polyester binder fiber having good processability and adhesiveness, and contributing to thinness of the resulting paper, which satisfies requests from users, can contribute to production of a fiber structure with high strength even thin in thickness. Where such a fiber structure with reduced thickness as well as enhanced strength is used for a filter application, the fiber structure can be used in an environment under a higher pressure than before. Further, in applications requiring fiber structures to have a required strength, binder fibers with a higher tenacity can lead to production of a fiber structure that has the same strength as the conventional fiber structure, even with a reduced basis weight, resulting in cost reduction.

Means for Solving the Problems

As a result of intensive studies conducted by the inventors of the present invention to achieve the above objects, the inventors of the present application have found that where a fiber is spun from a polyester resin containing an amorphous polyether imide in a proportion of 0.1 to 5.0 mass % (based on the mass of the polyester polymer), the fiber has a lower crystallization temperature and exhibits higher adhesiveness, when compared with conventional polyester fibers. Based on the above finding, the inventors reached to the present invention.

That is, a first aspect of the present invention is a polyester binder fiber including a polyester polymer and an amorphous polyether imide polymer in a proportion of 0.1 to 5.0 mass % (based on the mass of the polyester polymer), the polyester binder fiber having a crystallization temperature measured by differential calorimetry in a range of 100° C. or higher and 250° C. or lower.

The polyester binder fiber may preferably be an undrawn fiber.

The polyester polymer may comprise a polyethylene terephthalate. The intrinsic viscosity of the polyester polymer may be from 0.4 to 1.1 dL/g.

The polyester binder fiber may have a single fiber fineness of 0.01 to 10 dtex.

The polyester binder fiber may have a circular cross-sectional shape, a modified cross-sectional shape, a cross-sectional shape of hollow fiber, or a cross-sectional shape of composite fiber (conjugated fiber). The polyester binder fiber may have a fiber length of 0.5 to 50 mm.

A second aspect of the present invention is a fiber structure including at least the above-mentioned polyester binder fibers and polyester subject fibers, in which the polyester subject fibers do not show any crystallization temperature; wherein the polyester subject fibers are bonded via the polyester binder fibers. The fiber structure may be a nonwoven fabric. The nonwoven fabric may be a wetlaid nonwoven fabric. The wetlaid nonwoven fabric may be a paper.

The present invention encompasses any combination of at least two features disclosed in the claims and/or the specification. In particular, the present invention encompasses any combination of at least two claims.

Effect of the Invention

A polyester binder fiber according to the first aspect of the present invention can be obtained by spinning a polymer blend containing a polyester and a small amount of an amorphous polyether imide. The obtained polyester binder fiber may have a low crystallization temperature and a small fineness of 2 dtex or smaller in an undrawn state. Thus obtained polyester binder fibers with the small fineness of 2 dtex or smaller as well as with the fineness of larger than 2 dtex can bond drawn polyester subject fibers with higher adhesiveness compared with binder fibers without an amorphous polyether imide, so that the obtained polyester binder fibers yield an improved fiber structure, such as a wetlaid nonwoven fabric and a paper. Moreover, a low crystallization temperature of the binder fiber makes it possible to shorten the period for heat treating and/or improve processing efficiency.

A fiber structure according to the second aspect of the present invention includes at least the polyester binder fibers (e.g., undrawn polyester binder fibers) and polyester subject fibers (e.g., drawn polyester fibers) and has a configuration in which the polyester subject fibers are bonded via the polyester binder fibers. Higher adhesivity of the polyester binder fibers to bind the polyester subject fibers makes it possible to impart higher tensile strength (paper strength) to various fiber structures, such as a wetlaid nonwoven fabric and a paper, even if the fiber structures have thin thickness.

Preferably, the polyester polymer included in the polyester binder fiber is the same species as the polyester polymer included in the polyester subject fiber.

DESCRIPTION OF THE EMBODIMENTS

According to an embodiment of the present invention, the polyester binder fiber is obtained by spinning a polyester resin containing an amorphous polyether imide polymer in a proportion of 0.1 to 5.0 mass % (based on the mass of the polyester polymer).

Polyester Polymer

The polyester polymer (hereinafter sometimes simply referred to as polyester) used in an embodiment of the present invention is a polyester having a fiber forming capability and containing an aromatic dicarboxylic acid as a main acid component. Examples of the polyester may include a polyethylene terephthalate, a polytetramethylene terephthalate, a polycyclohexylenedimethylene terephthalate, and other polyesters. Moreover, these polyesters may be copolymers comprising another alcohol or another carboxylic acid (isophthalic acid etc.) to be copolymerized as a third component. Especially, polyethylene terephthalate is most preferable. From the viewpoint of spinnability of a polyester used and physical properties of obtained fibers, the polyester may have an intrinsic viscosity of preferably 0.4 to 1.1 dL/g, more preferably 0.4 to 1.0 dL/g, still more preferably 0.4 to 0.9 dL/g, and especially preferably 0.4 to 0.8 dL/g.

Polymer to be Blended with Polyester Polymer

According to an embodiment of the present invention, as the polymer to be blended with the polyester, there may be mentioned an amorphous polyether imide polymer (hereinafter sometimes simply referred to as amorphous polyether imide) that is a polymer highly compatible with polyesters and has an effect of lowering crystallization temperatures of polyesters.

The amorphous polyether imide used in the present invention may include, for example, a polymer including a combination of repeating structural units represented by the following formula: where $R_1$ represents a divalent aromatic residue with 6 to 30 carbon atoms, and $R_2$ is a divalent organic group selected from a group consisting of a divalent aromatic residue with 6 to 30 carbon atoms, an alkylene group with 2 to 20 carbon atoms, a cycloalkylene group with 2 to 20 carbon atoms, and a polydiorganosiloxane group in which chain is terminated with an alkylene group having 2 to 8 carbon atoms.

Chem. 1

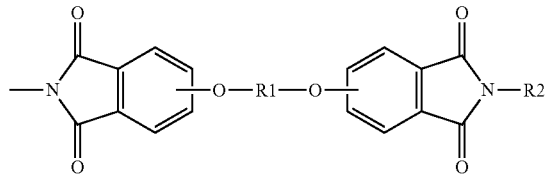

It is preferable to use a polymer, for example, having an aromatic residue and/or an alkylene group (e.g. m=2 to 10) represented by the following formulae as $R_1$ and $R_2$.

Chem. 2

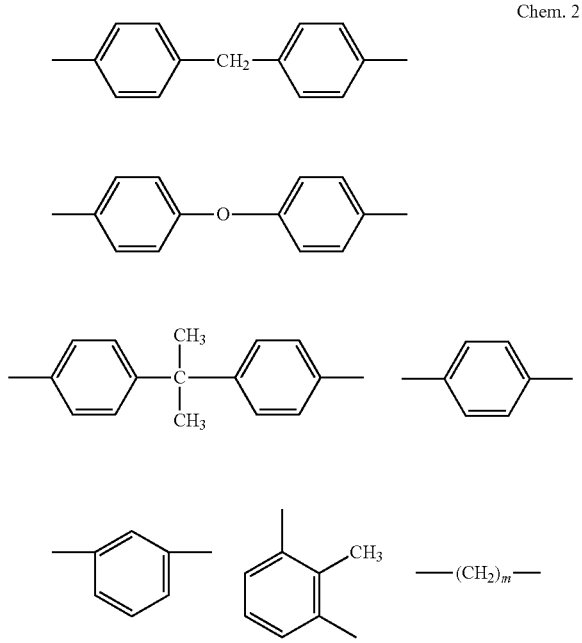

In the present invention, it is preferable to use a condensate of a 2,2-bis[4-(2,3-dicarboxyphenoxy)phenyl]propane dianhydride and a m-phenylenediamine which contains a structural unit represented by the following formula as a main component, in terms of amorphous property (noncrystallinity), melt formability and cost. Such a polyether imide is commercially available from SABIC Innovative Plastics under the trademark of "ULTEM".

Chem. 3

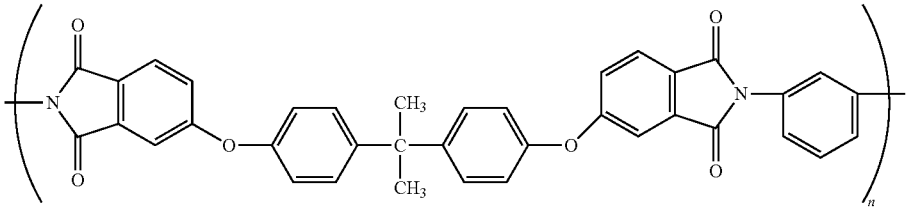

Arbitrary methods can be employed when adding an amorphous polyether imide to a polyester. For example, the addition may be carried out during the polymerization process of a polyester. Alternatively, a polyester and an amorphous polyether imide may be melt-kneaded, extruded, and cooled, and then the cooled material may be cut into chips. Furthermore, after preparing polyester chips and amorphous polyether imide chips, their chips can be mixed and be subjected to melt-spinning. Where kneading the polymers in molten state, it is preferable to use a screw-type melt extruder in order to enhance the degree of kneading. In any way, it is important to fully mix or knead the polymers such that the added amorphous polyether imide is finely and uniformly dispersed in the polyester.

The addition amount of the amorphous polyether imide in the present invention is required to be 0.1 to 5.0 mass % on the mass basis of the polyester, preferably 0.15 to 5.0 mass %, more preferably 0.2 to 5.0 mass %, and still more preferably 0.3 to 5.0 mass %. Even if the amorphous polyether imide is added in a proportion of 0.1 to 5.0 mass %, the intrinsic viscosity value of the obtained polyester resin is hardly influenced. Where the addition amount is less than 0.1 mass %, decrease in a crystallization temperature of the polyester is not observed. On the other hand, where the addition amount exceeds 5.0 mass %, crystallization proceeds during the spinning process, which results in the obtained fiber not exhibiting the binder performance. Thus, such an addition amount is not preferable.

Single Fiber Fineness

The polyester resin containing an amorphous polyether imide in a proportion of 0.1 to 5.0 mass % can be subjected to the ordinary spinning method so as to produce a polyester binder fiber in undrawn state. Blending the amorphous polyether imide improves spinnability of the polyester blend, compared with the spinnability of the polyester without the amorphous polyether imide. Consequently, it is possible to produce an undrawn polyester fiber having a small fineness (for example, 0.01 to 2.0 dtex). Further, as shown in the below-mentioned Examples, it is possible to obtain an undrawn polyester binder fiber that has a low crystallization temperature and is excellent in adhesiveness.

The single fiber fineness of the polyester binder fiber may be preferably 0.01 dtex or larger and 10 dtex or smaller, more preferably 0.01 dtex or larger and 5.0 dtex or smaller, and still more preferably 0.01 dtex or larger and 2.0 dtex or smaller.

Here, for example, in the production process of drylaid nonwoven fabrics using a carding machine etc., if fibers with too small fineness are fed to the machine, fiber breakage may appear. For this reason, the undrawn polyester binder fiber for drylaid nonwoven fabrics may have a single fiber fineness of preferably 0.1 dtex or larger and 10 dtex or smaller.

In contrast, production of wetlaid nonwoven fabrics (for example, a method of papermaking from a water dispersion of fibers) is less likely to cause fiber breakage when compared with production of drylaid nonwoven fabrics because the process of producing the wetlaid nonwoven fabrics does not adopt mechanical interlacing of the fibers using a carding machine, etc. For this reason, the undrawn polyester binder fiber for producing wetlaid nonwoven fabrics may have a single fiber fineness of preferably 0.01 dtex or larger and 10 dtex or smaller. Where the polyester binder fiber has a single fiber fineness that is too large, the weight per fiber will increase. Accordingly, for example, where a paper having a predetermined basis weight is produced, the number of binder fibers per unit area of the paper may decrease, resulting in deteriorated binder effect of the binder fibers. As a result, the binder fibers may unfavorably have declined adhesiveness or cause difficulty in production of fiber structures, such as a wetlaid nonwoven fabric and a paper, with uniform bonding strength.

The undrawn polyester binder fiber for producing a woven or knitted fabric may have a single fiber fineness of preferably 0.1 dtex or larger and 10 dtex or smaller.

Crystallization Temperature

According to an embodiment of the present invention, in order to function as a binder fiber, the polyester binder fiber is required to have a crystallization temperature measured in accordance with differential calorimetry. The present polyester fibers function as binder fibers because they exhibit adhesiveness during heating process by allowing them to be heated to the crystallization temperature or higher. As a result, they bind subject fibers, such as drawn polyester fibers, so as to give a fiber structure. On the other hand, polyester fibers without any crystallization temperature such as drawn polyester fibers do not function as binder fibers. It should be noted that the fiber structure, even containing the binder fibers used for adhesion, preferably does not show any crystallization temperature in accordance with differential calorimetry (differential thermal analysis).

The crystallization temperature of the present polyester binder fiber is required to be 100° C. or higher and 250° C. or lower, preferably 105° C. or higher and 220° C. or lower, and more preferably 105° C. or higher and 200° C. or lower. There is a possibility that a binder fiber having a crystallization temperature of lower than 100° C. may crystallize during drying process so that a desired paper strength may not be achieved; such a polyester binder fiber may fail to exhibit any crystallization temperature due to exposure to heat during handling procedure. Where a binder fiber has a crystallization temperature exceeding 250° C., due to a small difference in temperature between the melting point of the polyester subject fiber and the crystallization temperature of the polyester binder fiber, temperature control during the heating process will be complicated. Further, the high temperature at which the polyester binder fiber with high crystallization temperature exhibits adhesiveness also causes fusion of the polyester subject fiber. As a result, production of a fiber structure cannot be performed due to fusion of the polyester subject fiber. Thus, such a high crystallization temperature is not preferable.

The crystallization temperature can be controlled by changing chip viscosity (intrinsic viscosity), single fiber fineness, and/or temperature conditions for spinning, besides changing the addition amount of the amorphous polyether imide. For example, a crystallization temperature can be increased by reducing chip viscosity (lowering polymerization degree), or by increasing spinning temperature. Moreover, a crystallization temperature can be reduced by increasing chip viscosity (raising polymerization degree), or by reducing spinning temperature.

Cross-Sectional Shape of Fiber

According to the present invention, spinning for producing the polyester binder fiber may be performed using an ordinal circular nozzle, or suitably using a nozzle for producing a fiber with modified cross-sectional shape, a composite fiber (sheath core composite fiber etc.), or a hollow-fiber.

Fiber Length

Moreover, the polyester binder fiber according to the present invention may have a fiber length of preferably 0.5 to 50 mm, more preferably 1 to 25 mm, and still more preferably 2 to 15 mm. For example, where producing a paper that is an embodiment of a wetlaid nonwoven fabric, a binder fiber with a fiber length of less than 0.5 mm may have difficulty in exhibiting sufficient paper strength because the number of the subject fibers to be connected by one binder fiber is decreased. On the other hand, where a binder fiber with a fiber length of over 50 mm is used, such binder fibers will be entangled with each other during the papermaking so that the entangled portion will appear as a defect portion of the paper, resulting in poor texture. Further, some of the binder fibers may gather in such a defect portion, possibly causing troubles in production process as well as decrease in paper strength. Moreover, in the process for producing the drylaid nonwoven fabric using a carding machine or others, it is necessary for a web comprising fibers to move down a line continuously without a break in the travelling direction. For this reason, the fiber length desirable in manufacture of drylaid nonwoven fabrics is preferably 10 to 50 mm, more preferably 15 to 50 mm, and still more preferably 20 to 50 mm.

In addition, an additional fiber (for example, a polyester fiber which does not have a crystallization temperature) and a binder fiber may be mix-spun for producing a woven or knitted fabric, and then the woven or knitted fabric may be heated to produce a fabric having bonded portion formed by melting of the binder fiber. The fiber length of the binder fiber for the woven or knitted fabric may be preferably in a range of 0.5 to 50 mm.

Additives

According to the present invention, the polyester binder fiber, if necessary, may comprise a delustering agent, a heat stabilizer, an ultraviolet radiation absorbent, an antistatic agent, a terminating agent, and a fluorescent brightener, and/or other additives.

Fiber Structure

The polyester binder fiber (hereinafter may be simply referred to as a binder fiber) according to the present invention can be used as a binder fiber for drylaid nonwoven fabric, and blended with a subject fiber comprising a drawn polyester fiber so as to produce a drylaid nonwoven fabric. Alternatively, the binder fiber can also exhibit a binder function in a woven or knitted fabric and/or quilting. In order for the binder fiber to exhibit a binder function in the production of a drylaid nonwoven fabric, the binder fiber may preferably be blended in a proportion of 5 to 95 mass % relative to subject fiber.

Furthermore, the binder fiber may be cut into, for example, 2 to 15 mm in length and mixed with a drawn polyester fiber as well as a pulp and/or other subject fiber for papermaking, and used for producing a wetlaid nonwoven fabric by exhibiting a binder function. By using the polyester binder fiber according to the present invention, various kinds of fiber structure can be produced. Among them, the wetlaid nonwoven fabric is the most preferable embodiment, and will be described in detail.

Here, a drylaid nonwoven fabric can be obtained by forming a web (using a carding machine etc.) without water and heating the web so that the fibers in the web can be bonded with binder fibers. Alternatively, a wetlaid nonwoven fabric can be obtained by forming a web (for example, with water in the process), drying the web if necessary, and heating the web so that the fibers in the web can be bonded with binder fibers. As the concrete method of forming a web in the process using water, there may be mentioned a papermaking method that comprises dispersing fibers in water to produce a paper-like web, a hydroentangling method that comprises forming a web without water and interlacing fibers in the web using water, and other methods.

Papermaking

The polyester binder fibers according to the present invention may be mixed with subject fibers such as drawn polyester fibers, so as to produce a wetlaid nonwoven fabric such as a paper by papermaking. After spinning, the polyester binder fiber for papermaking may be cut into 0.5 to 50 mm, preferably 2 to 15 mm, in cut length and then fed into a papermaking machine. The binder fibers each having a cut length that is too short tend to be insufficient in respect of the adhesiveness for binding subject fibers. The binder fibers each having a cut length that is too long tend to be easily entangled with each other so as to have declined water dispersibility.

The subject fibers such as drawn polyester fibers may contain a polyester used for the present polyester binder fiber as a principal component. It should be noted that the drawn polyester fibers do not substantially include the amorphous polyether imide. The fineness of the subject fiber such as a drawn polyester fiber may be preferably 0.01 dtex or larger and 20 dtex or smaller, more preferably 0.01 dtex or larger and 15 dtex or smaller, and still more preferably 0.01 dtex or larger and 10 dtex or smaller. The subject fibers each having a fineness exceeding the upper limit may decline in the number of fibers constituting a paper, resulting in reduced paper strength. The subject fibers each having a fineness under the lower limit are easily entangled with each other during papermaking due to the excessively small fineness, resulting in occurrence of fault portions that are disadvantageous for producing uniform paper.

In wetlaid nonwoven fabrics, the mass ratio (subject fiber/binder fiber) of the subject fiber (drawn polyester fiber) and the binder fiber may be 95/5 to 5/95, preferably 80/20 to 20/80, more preferably 75/25 to 25/75, still more preferably 70/30 to 30/70, and particularly preferably 70/30 to 50/50. Where the content of the binder fiber is too small, that leads to an excessively reduced number of bonding points between fibers that constitute the wetlaid nonwoven fabric, so that the wetlaid nonwoven fabric tends to have insufficient strength. On the other hand, where the content of the binder fiber is too high, that leads to an excessively increased number of bonding points between fibers, so that the wetlaid nonwoven fabric tends to become stiff and therefore is not preferable.

According to the present invention, a mixture of the binder fibers and the subject fibers is subjected to papermaking and dried by a Yankee dryer (110° C.). Then the dried web is heat-treated in the pressing process at a high temperature of usually 180° C. or higher and 250° C. or lower. The heat-treating period during the pressing process may be preferably 15 minutes or less, more preferably 12 minutes or less, and still more preferably 10 minutes or less. By adjusting the heat-treating period and temperature in the pressing process, the binder fiber having an amorphous part can be heated to a temperature of the crystallization temperature or higher and be crystallized in a state of binding subject fibers. Accordingly, the crystallization temperature of the binder fiber disappears so that higher paper strength can be achieved.

Further, in the present invention, since addition of the amorphous polyether imide to the polyester lowers the crystallization temperature, it is possible to shorten the heat-treating period in the pressing process and improve processing efficiency.

The papermaking method can be carried out by ordinal methods, using a cylinder-screen paper-making system, a short-screen paper-making method, and other method.

EXAMPLES

Hereinafter, the present invention will be described in more detail by way of some examples that are presented only for the sake of illustration, which are not to be construed as limiting the scope of the present invention. It should be noted that measurement and evaluation were performed in the following manners in the present invention.

Intrinsic Viscosity

The intrinsic viscosity (dL/g) of a sample was measured using an Ubbelohde viscometer ("HRK-3", produced by Hayashi Seisakusho Co., Ltd.) in accordance with JIS K 7367-1. The solvent used for measurement was a mixed solvent of phenol/tetrachloroethane (volume ratio of 1/1) at 30° C.

Cross-Sectional Shape

After spinning to obtain a wound fiber, the fiber was cut using a razor in the perpendicular direction to the longitudinal direction of the fiber. The cross-sectional shape of the fiber after cutting was observed using a micro scope (VHX-5000) produced by KEYENCE CORPORATION.

Single Fiber Fineness

The single fiber fineness (dtex) was determined in accordance with JIS L 1015 "the chemical fiber staple examination method (8.5.1)".

Crystallization Temperature

The crystallization temperature of a sample was measured in accordance with a method described in JIS K 7121-1987 using a thermogravimetry and differential thermal analyzer "Thermoplus TG8120" produced by Rigaku Corporation.

Processability

The processability of a sample was evaluated in accordance with the following criteria:

Good: With no fall off of the fibers to a roller in the pressing process.

Poor: With fall off of the fibers to a roller or with adhesion of the obtained paper to a roller in the pressing process.

Paper Strength (Tensile Strength)

The paper strength (tensile strength) (kg/15 mm) was measured by the examining method in accordance with JIS P 8113. It should be noted that a paper strength (tensile strength) value (kg/15 mm) can be converted into a value "kN/m" by the following formula.

$$\text{"Value"(kN/m)}=\text{"Value"(kg/15 mm)}\times 66.7\times(1000/15)/9.8$$

Paper Thickness

The paper thickness (mm) was measured by an examining method in accordance with JIS P 8118.

Evaluation in Water Immersion

A sample of the obtained paper was immersed in water at 25° C. for 1 hour, and determined appearance change of the paper sample.

A: With no change on appearance.

B: With change such as tearing.

Examples 1 to 5 and Comparative Examples 1 to 3

Polyester Binder Fiber

Polyethylene terephthalate chips (polyester chip produced by Kuraray Co., Ltd.) were used and dried in an ordinal method. Then, chips of an amorphous polyether imide, hereafter may be abbreviated as PEI, ("ULTEM" ™, ULTEM9001, produced by SABIC-IP) were mixed to the polyethylene terephthalate chips in accordance with determined ratios. The mixtures were melted at 300° C. so that the PEI was uniformly dispersed in the polyethylene terephthalate. The PEI blend ratios and chip viscosities in Examples and Comparative Examples are shown in Table 1. In each of Examples and Comparative Examples, the molten polymer blend was metered using a gear pump, and discharged at a predetermined amount from a spinning nozzle (hole size=φ 0.16; number of holes=1880) (nozzle temperature: 300° C.), and the discharged filaments were wound up at a winding speed of 1400 m/min to produce undrawn polyester fibers. Thus obtained undrawn polyester fibers have crystallization temperatures of 117 to 127° C. measured using the above-described thermogravimetric-differential thermal analyzer. In Comparative Examples 1 and 2, the spinning was performed without blending PEI. The cross-sectional shape and the single fiber fineness of the obtained fibers are shown in Table 1.

Papermaking

The binder fibers each cut into 5 mm in length and polyester subject fibers ("EP-053" produced by Kuraray Co., Ltd.; single fiber fineness: 0.8 dtex, cut length: 5 mm) were fed to a disintegrator (produced by TESTER SANGYO CO., LTD.) in the mass ratio of the binder fiber to the subject fiber (binder fiber: subject fiber)=40:60. After disintegration of the fibers at 3000 rpm for 1 minute, papermaking was carried out with respective binder fibers in Examples and Comparative Examples using a TAPPI-papermaking machine (produced by KUMAGAI RIKI KOGYO Co., Ltd.) so as to obtain a web having a basis weight of 60 g/m$^2$. Then, the obtained web was pressed for 30 seconds under a pressure of 3.5 kg/cm$^2$ using a pressing machine (produced by KUMAGAI RIKI KOGYO Co., Ltd.) for moisture adjustment, and dried at 120° C. for 45 seconds using a rotary dryer (produced by KUMAGAI RIKI KOGYO Co., Ltd.) to obtain a paper-type wetlaid nonwoven fabric. Subsequently, the wetlaid nonwoven fabric was heat-treated for 2 seconds through a heat press roller (220° C., crevice: 0.1 mm) to obtain a paper (15 mm×100 mm strip) without crystallization temperature.

With respect to papers obtained in Examples and Comparative Examples, Table 1 shows the results of basis weight, processability, paper thickness, and paper strength, and evaluation in water immersion.

TABLE 1

| | Binder fiber | | | | |
|---|---|---|---|---|---|
| | PEI addition amount (mass %) | PET intrinsic viscosity [η] (dL/g) | Cross-sectional Shape | Single fiber fineness (dtex) | Crystallization temperature (° C.) |
| Ex. 1 | 1.0 | 0.575 | Circular | 1.0 | 117.0 |
| Ex. 2 | 1.0 | 0.575 | Circular | 1.5 | 121.0 |
| Ex. 3 | 3.0 | 0.575 | Circular | 1.0 | 121.0 |
| Ex. 4 | 0.1 | 0.575 | Circular | 1.5 | 126.0 |
| Ex. 5 | 1.0 | 0.575 | Hollow | 2.2 | 122.0 |
| Com. Ex. 1 | 0.0 | 0.575 | Circular | 1.0 | 123.0 |
| Com. Ex. 2 | 0.0 | 0.575 | Circular | 1.5 | 127.0 |
| Com. Ex. 3 | 7.0 | 0.575 | Circular | 1.5 | — |

| | Papermaking | | | | | | | | | | |
|---|---|---|---|---|---|---|---|---|---|---|---|
| | Blend ratio (%) | | Heat-pressing | | Basis weight ($g/m^2$) | | Evaluation of obtained paper | | | | |
| | Binder fiber | Subject fiber | Temperature (° C.) | Period (s) | Raw paper | Heat-pressed paper | Process-ability | Paper thickness (mm) | Paper strength (Tensile strength) (kg/15 mm) | Paper strength (Tensile strength) (kN/m) | Evaluation in water immersion |
| Ex. 1 | 40 | 60 | 220 | 2 | 60 | 85 | Good | 0.198 | 3.53 | 0.360 | A |
| Ex. 2 | 40 | 60 | 220 | 2 | 60 | 86 | Good | 0.202 | 3.51 | 0.358 | A |
| Ex. 3 | 40 | 60 | 220 | 2 | 60 | 86 | Good | 0.200 | 3.47 | 0.354 | A |
| Ex. 4 | 40 | 60 | 220 | 2 | 60 | 86 | Good | 0.207 | 3.72 | 0.379 | A |
| Ex. 5 | 40 | 60 | 220 | 2 | 60 | 88 | Good | 0.208 | 3.43 | 0.350 | A |
| Com. Ex. 1 | 40 | 60 | 220 | 2 | 60 | 86 | Poor | 0.230 | 3.10 | 0.316 | A |
| Com. Ex. 2 | 40 | 60 | 220 | 2 | 60 | 88 | Poor | 0.244 | 2.92 | 0.298 | A |
| Com. Ex. 3 | 40 | 60 | 220 | 2 | 60 | 79 | Poor | 0.306 | 1.95 | 0.199 | B |

The followings are found from the results in Table 1.

(1) A comparison is made between Comparative Examples 1 and 2 without addition of PEI and Examples 1 and 2 with PEI blended in a proportion of 1.0 mass %. Although Comparative Example 1 having a single fiber fineness of 1.0 dtex had a paper thickness of 0.230 mm and a paper strength of 3.10 kg/15 mm, Example 1, even having the same single fiber fineness, achieved a paper thickness of 0.198 mm and a paper strength of 3.53 kg/15 mm, showing that PEI addition effectively decreases paper thickness while increases paper strength. Further, adhesion to the roller was also decreased.

Similarly, although Comparative Example 2 having a single fiber fineness of 1.5 dtex had a paper thickness of 0.244 mm and a paper strength of 2.92 kg/15 mm, Example 2, even having the same single fiber fineness, achieved a paper thickness of 0.202 mm and a paper strength of 3.51 kg/15 mm, similarly showing that PEI addition effectively decreases paper thickness while increases paper strength. Further, adhesion to the roller was also decreased.

(2) Example 3 with PEI blended in a proportion of 3.0 mass % and Example 4 with PEI blended in a proportion of 0.1 mass % also showed that adhesion to the roller was eliminated and that decreased paper thickness as well as increased paper strength were effectively attained, as in the above-described Examples.

(3) In Comparative Example 3, a binder fiber (1.5 dtex) with PEI blended in a proportion of 7.0 mass % was obtained. The binder fiber did not exhibit binder performance because crystallization of the binder fiber occurred during spinning, resulting in deteriorated paper strength of 1.95 g/15 mm.

(4) Example 5 where hollow fibers were formed with PEI blended in a proportion of 1.0 mass % also achieved a paper thickness and a paper strength equivalent to those of Example 1.

INDUSTRIAL APPLICABILITY

The polyester binder fiber according to the present invention is useful as a binder fiber of the fiber structure containing a drawn polyester fiber.

As mentioned above, the embodiments of the present invention are specifically illustrated with reference to Examples, but one skilled in the art would easily make various changes or modifications in view of the present description, without departing from the spirit or scope of the present invention. Therefore, it is to be understood that such changes or modifications may be interpreted to fall within the spirit or scope of the present invention determined from claims.

What is claimed is:

1. A polyester binder fiber, comprising:

a polyester polymer and an amorphous polyether imide polymer in a proportion of 0.1 to 5.0 mass % based on the mass of the polyester polymer, the polyester binder fiber having a crystallization temperature measured by differential calorimetry in a range of 100° C. or higher and 250° C. or lower, wherein the polyester binder fiber has a single fiber fineness of 0.01 to 10 dtex.

2. The polyester binder fiber as claimed in claim 1, wherein the polyester binder fiber is an undrawn fiber.

3. The polyester binder fiber as claimed in claim 1, wherein the polyester polymer comprises a polyethylene terephthalate.

4. The polyester binder fiber as claimed in claim 1, wherein the polyester polymer has an intrinsic viscosity of 0.4 to 1.1 dL/g.

5. The polyester binder fiber as claimed in claim 1, wherein the polyester binder fiber has a single fiber fineness of 0.01 to 5.0 dtex.

6. The polyester binder fiber as claimed in claim 1, wherein the polyester binder fiber has a circular cross-sectional shape, a modified cross-sectional shape, a cross-sectional shape of hollow fiber, or a cross-sectional shape of composite fiber.

7. The polyester binder fiber as claimed in claim 1, wherein the polyester binder fiber has a fiber length of 0.5 to 50 mm.

8. A fiber structure, comprising at least:

the polyester binder fibers as recited in claim 1, and polyester subject fibers without any crystallization temperature, the polyester subject fibers being bonded via the polyester binder fibers.

9. The fiber structure as claimed in claim 8, wherein the fiber structure is a nonwoven fabric.

10. The fiber structure as claimed in claim 9, wherein the nonwoven fabric is a wetlaid nonwoven fabric.

11. The fiber structure as claimed in claim 10, wherein the wetlaid nonwoven fabric is a paper.

* * * * *